United States Patent [19]

Richter

[11] Patent Number: 4,748,910

[45] Date of Patent: Jun. 7, 1988

[54] PRINTING MACHINE PULLING ROLLER PAIR

[75] Inventor: Johannes Richter, Augsburg, Fed. Rep. of Germany

[73] Assignee: Man Roland Druckmaschinen Aktiengesellschaft, Offenbach-am-Main, Fed. Rep. of Germany

[21] Appl. No.: 941,409

[22] Filed: Dec. 15, 1986

[30] Foreign Application Priority Data

Dec. 20, 1985 [DE] Fed. Rep. of Germany ..... 3545295

[51] Int. Cl.[4] ..... B41F 13/02

[52] U.S. Cl. ..... 101/228; 101/219; 101/216

[58] Field of Search ..... 101/212, 216, 377, 409, 101/415.1, 228, 219; 226/181, 182, 183; 118/DIG. 15; 29/110, 121.1, 121.5

[56] References Cited

U.S. PATENT DOCUMENTS

| | | | |
|---|---|---|---|
| 486,631 | 11/1892 | Crossley | 29/121.5 |
| 2,219,077 | 10/1940 | Pharo | 29/121.5 |
| 2,434,820 | 1/1948 | Tifft | 29/121.1 |
| 3,022,231 | 2/1962 | Bloderick | 29/121.5 |
| 3,060,545 | 10/1962 | Thiel | 29/121.5 |
| 4,291,438 | 9/1981 | Seiki | 29/121.1 |

FOREIGN PATENT DOCUMENTS

| | | |
|---|---|---|
| 2357208 | 5/1975 | Fed. Rep. of Germany . |
| 2356208 | 5/1975 | Fed. Rep. of Germany . |

*Primary Examiner*—Edgar S. Burr
*Assistant Examiner*—Huong Q. Pham
*Attorney, Agent, or Firm*—Frishauf, Holtz, Goodman & Woodward

[57] ABSTRACT

To exert tension on a moving web, typically a paper web pulled over a folding former of a printing machine, the pull-off rollers are formed with axial grooves which are filled with strips of elastic material, such as plastic or rubber; preferably, the width of the ribs, which can be steel, is slightly less than the circumferential width of the elastic insert strips to provide for slight pinching of engagement surfaces between the ribs (9) and the elastic insert strips (10)—see FIG. 2. The strips and ribs extend over the entire axial length of the rollers to provide an axially uniform tension over the entire width of the web material.

5 Claims, 1 Drawing Sheet

PRINTING MACHINE PULLING ROLLER PAIR

The present invention relates to pulling rollers, and more particularly to a pulling roller pair, for use in a rotary printing machine to transport substrates for printed material, for example movable printed webs passed between the respective rollers of the roller pair. The two rollers operate at a circumferential linear speed which is slightly higher than the run-in speed of the substrate web to exert a tension or pull on the web.

BACKGROUND

It has previously been proposed to place elastic inserts at the circumference of pulling rollers, in which the respective elastic inserts are offset with respect to non-elastic or inelastic inserts, see the referenced German Pat. No. 23 57 208. This German patent discloses a roller pair in which the inserts are formed as alternating steel rings and rubber rings to form, alternatingly, ring zones of elastic and, respectively, less elastic or non-elastic material. The arrangement is so made that the non-elastic ring zones of one roller continuously run off with their entire width on the elastic ring zones of the opposite or matching roller. The elastic ring zones always have the same width as the relatively non-elastic ring zones.

It has been found that such a tension roller is expensive to make and leads to substantial wear, particularly due to deformation of the elastic rings in running direction. Due to the differential pairing of the rings, changes in diameter of the elastic rings result in increased kneading action of the elastic material, resulting in substantial heating and wear. Additionally, the printed web is longitudinally deformed, and such longitudinal deformation, for example resulting in slight ridges or grooves or corrugations, may propagate themselves along the moving web, for example up to a folding former. As a result, the web is not uniformly tensioned throughout its entire width, which may interfere with formation of the longitudinal fold over a folding former at a desired transverse position.

THE INVENTION

It is an object to provide a pulling roller pair which can be made inexpensively, exerts uniform pull on the substrate web over its entire width, and has a long lifetime.

Briefly, the two rollers are formed with axial grooves which define, between the grooves, separating ribs or ridges. The grooves are filled with a material which is relatively inelastic with respect to that of the separating grooves or ribs. The width of the ribs or ridges at the circumference of the respective roller, is up to, but preferably slightly less than the width dimension of the grooves so that, in operation, the ridges or ribs can depress ever so slightly into the grooves. The relatively elastic material will form, together with the ribs, a surface having essentially uniform circumference, that is, being of essentially uniform radius. Since the grooves and ribs extend axially, the substrate is not deformed longitudinally and handling of the substrate, typically a paper web, subsequent to the pulling rollers, is facilitated.

DRAWINGS

FIG. 1 is a perspective view of a pulling roller pair in accordance with the present invention, illustrating use of the pulling roller to pull a paper web off a folding former; and FIG. 2 is a fragmentary schematic cross section through a pulling roller pair illustrating the gripping action of the pulling rollers.

DETAILED DESCRIPTION

Figure 1:
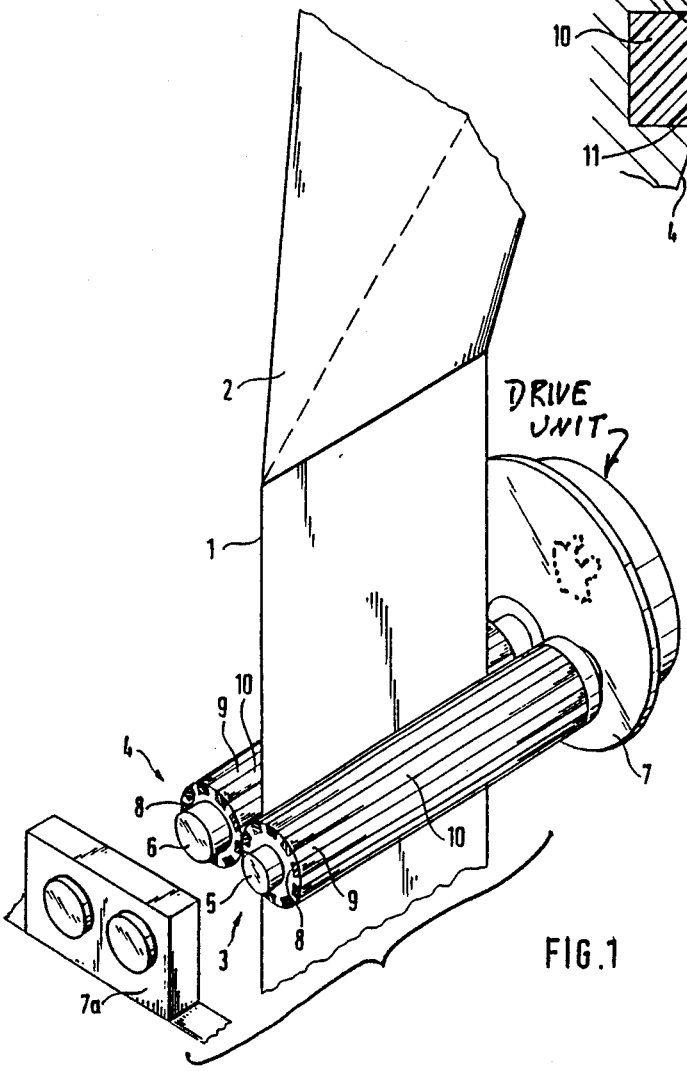

A substrate web 1, typically a paper web, is passed over a folding former 2 and supplied to a pulling roller pair. The pulling roller pair has two rollers 3, 4. The rollers 3 and 4 terminate in stub shafts 5, 6. The pulling roller pair can be retained at one side in a bearing support ring 7 which, typically, is located within a side wall of a printing machine. The stub shafts 5, 6 at the forward side—with respect to FIG. 1—of the pulling rollers 3, 4 are retained in a bearing block **7*a* which in FIG. 1** is shown in exploded position.

In the position shown, the pulling rollers 3, 4 are in engagement with each other, with the web 1 interposed. Preferably, the pulling rollers are retained in bearings only at one side wall, for example in the structure 7, in which, also, the drive for the pulling roller may be placed.

The pulling rollers 3, 4 are located eccentrically within a rotatable, adjustable side wall portion 7. This arrangement permits alignment of the pair of pulling rollers 3, 4 with respect to the tip of the former 2, so that the nip will be precisely in running alignment with the tip; adjustment, thus, is simple and correction of the alignment can be readily effected.

In accordance with a feature of the invention, the rollers 3, 4, which are formed of steel, have axially directed grooves 8 formed on the circumference of the rollers. The grooves are separated by ribs 9, formed of the base material, in the example of steel. The grooves 8 are filled with a material which is more elastic than the material of the ribs 9, to form elastic strips 10. Plastic or rubber are suitable as materials for the strips 10. Preferably, the ribs 9 as well as the grooves 8 and, hence, the elastic strip 10, extend over the entire axial length of the rollers 3, 4. The grooves 8 may have square cross section or can be formed slightly dovetail-shaped, and the strips 10 pulled or snapped into the grooves, to be retained therein by slight compression, friction or by means of an adhesive.

Figure 2:
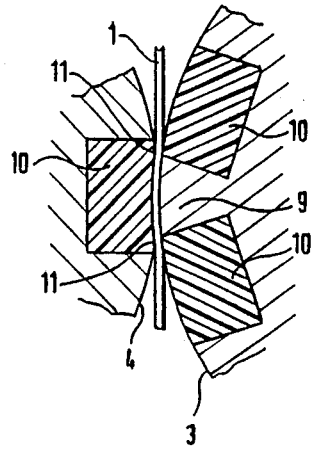

In accordance with a feature of the invention, the width of the ribs 9, at the circumference, with respect to the width of the elastic strips 10, is preferably slightly smaller than the width of the strips 10. FIG. 2 illustrates the arrangement which results in a slight squeezing or deformation zone 11. The squeezing zone is of very small depth, for example in the region of thousands of a millimeter and FIG. 2 illustrates the deformation in substantially exaggerated form for better visualization. The arrangement then provides for uniform tension for transport of the web 1 through the rollers over the entire axial length of the rollers, and the entire width thereof.

Manufacture of the pair of rollers 3, 4 is substantially simplified over that of the roller pair of the prior art, since it is only necessary to form the rollers 3, 4 as elongated cylinders and then mill the grooves 8 axially therein. The grooves 8 are then filled with elastic material to form an essentially uniform cylindrical circumference. The pitch or ratio of circumferential width between grooves and ribs is so set, in dependence on the axial length of the rollers 3, 4 and the diameter thereof, that a predetermined permissible slippage, in view of the higher speed drives of the rollers with respect to the supply speed of the web 1, will result without excessive wear on the web 1. As best seen in FIG. 2, dimensional relations which result in very slight penetration of the ribs 9 into the elastic strips 10 to result in the squeezing zones 11 is desirable. Slippage is low and taut tension on the web is maintained. It is possible to make the widths at the circumference of the ribs 9 and of the strips 10 identical, although slightly narrower ribs 9 are preferred.

Various changes and modifications may be made within the scope of the inventive concept.

As seen in FIG. 2, the rollers are circumferentially so aligned with each other that the ribs 9 of one roller engage over the elastic strips 10 of the other roller 4, so that the pinch zones 11 will be formed alternately at the respective rollers for continuous pull on the web 1, and uniform wear of the rollers and circumferential portions thereof.

I claim:

1. A pulling roller pair for pulling a printed substrate through a web handling apparatus comprising a pair of drive rollers, said rollers being mounted to form a nip through which said printed substrate passes, each of said rollers being formed with axial grooves separated by ribs, said grooves being filled with a material which is more elastic than said ribs to form with said ribs a surface having a circumference of essentially uniform radius, the ribs each having a circumferential extent not greater than the circumferential extent of said grooves, said rollers being rotatably arranged so that one of said rollers has a rib surface at said nip when the other of said rollers has a groove filled with said more elastic material at said nip whereby each side of said web is sequentially and repeatedly contacted by alternating rib surfaces and surfaces of said more elastic material.

2. The roller pair of claim 1, wherein the ribs (9) are steel;

and said material (10) which is more elastic than the ribs (9) of steel comprises strips of rubber or plastic.

3. The roller pair of claim 1, wherein the rollers are supported in a side portion unit (7) including a roller drive structure.

4. The roller pair of claim 1, wherein the circumferential dimension of the ribs is smaller than the circumferential dimension of the grooves and hence of the material filling the grooves.

5. The roller pair of claim 2, wherein the circumferential dimension of the ribs is smaller than the circumferential dimension of the grooves and hence of the material filling the grooves.

* * * * *